US006607086B1

(12) United States Patent
Gretz

(10) Patent No.: US 6,607,086 B1
(45) Date of Patent: Aug. 19, 2003

(54) HANGER ASSEMBLY

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 0 days.

(21) Appl. No.: 10/012,582

(22) Filed: Nov. 7, 2001

(51) Int. Cl.[7] ..... A47F 5/00
(52) U.S. Cl. ..... 211/123; 52/702; 248/343
(58) Field of Search ..... 248/300, 343, 248/324, 906; 52/702; 403/232.1, 200.1; 211/123, 116

(56) References Cited

U.S. PATENT DOCUMENTS 2,233,334 A * 2/1941 Austin
4,158,940 A * 6/1979 Lancelot et al. ..... 52/702
4,261,155 A * 4/1981 Gilb ..... 52/702
5,555,694 A * 9/1996 Commins ..... 52/702
5,938,157 A * 8/1999 Reiker ..... 248/906 X
5,954,304 A * 9/1999 Jorgensen ..... 248/343 X

* cited by examiner

*Primary Examiner*—Robert W. Gibson, Jr.

(57) ABSTRACT

A hanger assembly comprised of a longitudinal member and end brackets attached to and pivotable with respect to the member. The length of the longitudinal member is selected to span the maximum distance typically encountered with overhead joists and beams. The hanger assembly provides the advantages of being of simple construction, inexpensive, capable of spanning a wide range of distances between joists, and allowing easy squaring of junction boxes with the room in which they are installed.

4 Claims, 5 Drawing Sheets

HANGER ASSEMBLY

FIELD OF THE INVENTION

This invention relates to hanger assemblies for suspending heavy objects such as ceiling fans, and particularly to a hanger assembly that may be easily installed to bridge the distance between two beams or joists. The hanger assembly will easily accommodate beams or joists spaced at various offsets.

BACKGROUND OF THE INVENTION

The National Electrical Code currently specifies a maximum acceptable weight of 80 pounds for ceiling light fixtures and 70 pounds for ceiling fans. It is therefore important to provide proper support for these potentially heavy devices to accommodate the static and, in the case of ceiling fans, dynamic loads that are encountered.

Light fixtures and ceiling fans are commonly mounted centrally on the ceiling of a room, and, in most cases, the exact center of a room does not coincide with the location of an overhead beam or joist from which to suspend the fixture. It therefore becomes necessary to provide overhead support in the exact center of the room from which to anchor the fixture or fan. Contractors typically provide overhead support by cutting a 2"×4" header to the proper size to bridge the distance between overhead joists and then fastening it to the joists with nails or screws.

Typically, in new home construction, the building is framed out well before the electrical contractor arrives to install ceiling fans, light fixtures, and other electrical devices. It therefore becomes impractical and inconvenient for an electrical contractor to carry a cutting device to the work site. A need therefore exists for a device and method to easily provide overhead support for a heavy hanging object such as a light fixture or a ceiling fan.

For installation of light fixtures and ceiling fans in existing homes, many manufacturers produce expandable fixture support units that are inserted through the normal junction box hole in a ceiling to save the effort of creating a larger hole. A typical fixture support unit of this type is disclosed in U.S. Pat. No. 4,463,923 to Reiker (hereinafter the '923 patent). This patent describes a heavy-duty expansible junction box hanger assembly adapted for installation from beneath a ceiling through a junction-box aperture in the ceiling without complete prior removal of a previously installed light-weight hanger assembly. The portion of the light-weight hanger directly above the aperture is cut away, and the heavy duty hanger is maneuvered through the aperture to a position above the light-weight hanger. A pair of feet on each end of the heavy duty hanger straddle the light-weight hanger and rest on the upper ceiling surface, aligning the heavy duty hanger parallel to the ceiling, after which joist engagement means on the hanger assembly are expanded into biting contact with the joists.

Although the '923 patent and similar devices provide an adequate device for providing overhead support for a heavy fixture, it and similar devices have the disadvantage of being composed of a number of mechanical parts, thereby making it a complex device that is relatively expensive to manufacture. It is limited to bridging a minimum distance of 14.25". Additionally, if the existing overhead joists are not arranged parallel to each other, no provision is made for squaring the junction box with the room. A need therefore exists for a simple, relatively inexpensive device for providing overhead support for a heavy hanging object such as a light fixture or a ceiling fan. Additionally, the device should be capable of bridging a wide range of distances between joists and allow for easy squaring of junction boxes with the room in which they are to be installed.

SUMMARY OF THE INVENTION

The present invention comprises a hanger assembly comprised of a longitudinal member and end brackets attached to and pivotable with respect to the member. The length of the longitudinal member is selected to span the maximum distance typically encountered with overhead joists and beams. The hanger assembly provides the advantages of being of simple construction, inexpensive, capable of spanning a wide range of distances between joists, and allowing easy squaring of junction boxes with the room in which they are installed.

INDEX TO REFERENCE NUMERALS IN DRAWINGS

Figure 2:
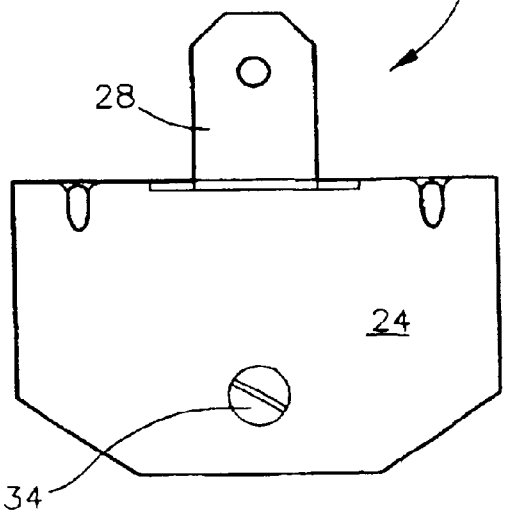
FIG. 2 is a bottom view of one of the end brackets of the hanger assembly depicted in FIG. 1.

10 hanger assembly
12 longitudinal member
14 end bracket
16 top (of longitudinal member)
18 bottom (of longitudinal member)
20 end flange
22 top flange
24 bottom flange
26 vertical tab
28 horizontal tab
30 channel
32 pivot pin
34 flathead screw
36 locking nut
38 aperture (in bottom flange)
40 aperture (in longitudinal member)
42 aperture (in top flange)
44 joist-accepting seat
46 aperture

48 joist
50 junction box
52 ceiling fan
54 ceiling
56 lower edge (of joist)
58 fastener

DETAILED DESCRIPTION OF THE INVENTION

Figure 1:
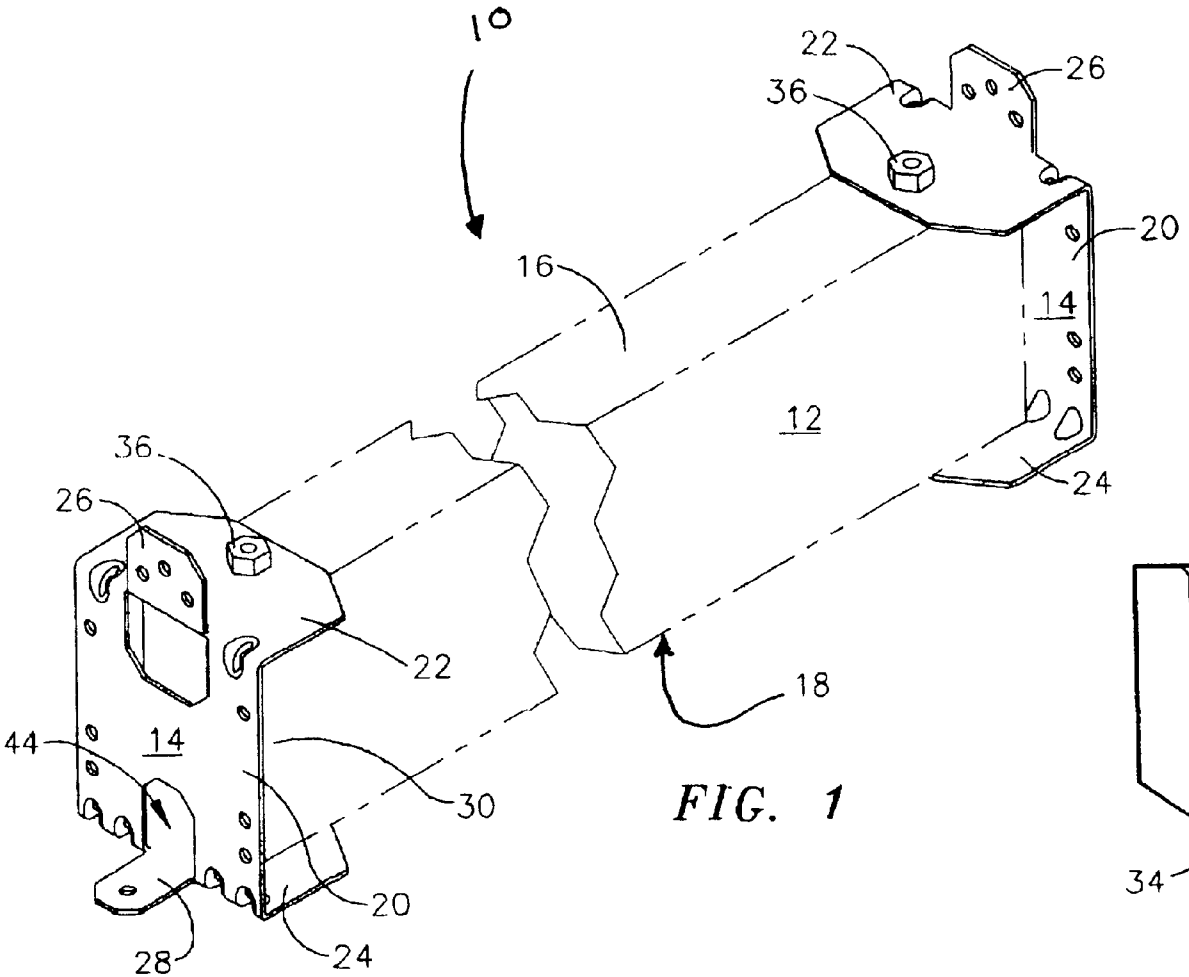
FIG. 1 is a perspective view of the preferred embodiment of the hanger assembly with the longitudinal member in phantom lines and having a portion broken away.
Figure 3:
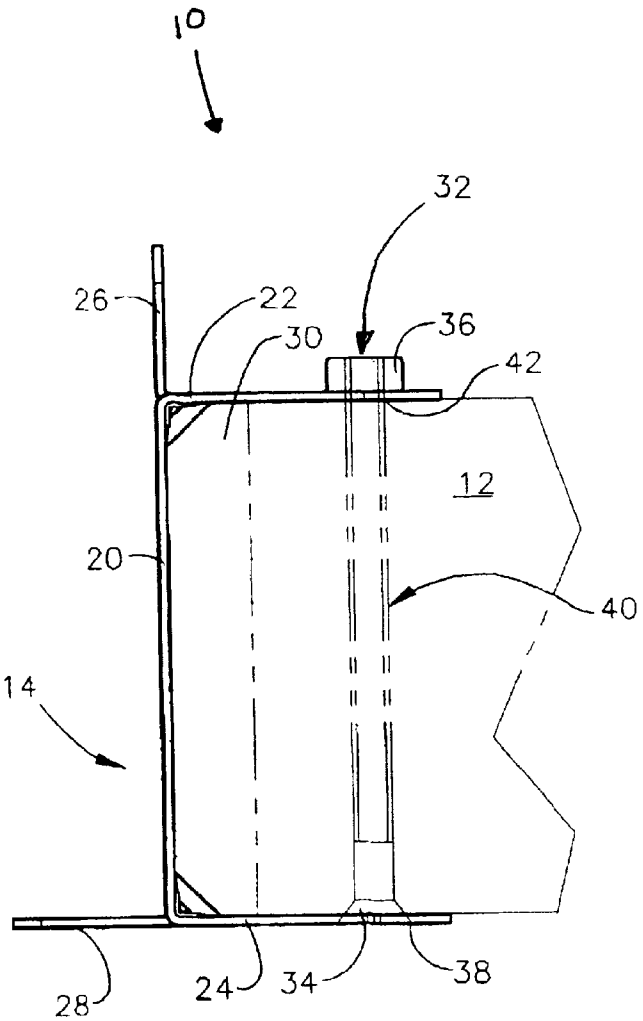
FIG. 3 is a side view of one end of the hanger assembly of FIG. 1.

Referring to FIG. 1 and FIG. 3, the preferred embodiment of a hanger assembly 10 according to the present invention includes a longitudinal member 12 and two end brackets 14 pivotably attached thereto. The hanger assembly 10, when placed into use, will be oriented as shown in FIG. 1, with the reference numeral 16 referring to the top and the reference numeral 18 referring to the bottom of the longitudinal member 12. The end brackets 14 are essentially U-shaped and consist of an end flange 20 and a top 22 and bottom 24 flange. A vertical tab 26 extends vertically from the junction of the end 20 and top 22 flange and a horizontal tab 28 extends horizontally from the junction of the end 20 and bottom 24 flange. The inside portion of the U-shaped end brackets 14 form a channel 30 capable of accepting the longitudinal member 12 therein. As shown in FIG. 3, a pivot pin 32, consisting of a flathead screw 34 and a locking nut 36 pivotably secure end bracket 14 to longitudinal member 12 through aperture 38 in the bottom flange 24, aperture 40 in longitudinal member 12, and aperture 42 in top flange 22. As shown on the far left of FIG. 3, a joist-accepting seat 44 is created on the outward surfaces of the horizontal tab 28, end flange 20, and vertical tab 26.

Referring to FIG. 2, an end bracket 14 is shown as viewed from the bottom 18 side of the longitudinal member 12 (shown in FIG. 1) and depicts the bottom flange 24 and the end of the flathead screw 34 which, in conjunction with the locking nut (not shown), form the pivot pin 32 that will secure the longitudinal member (not shown) rotatably to each end bracket 14.

Figure 4:
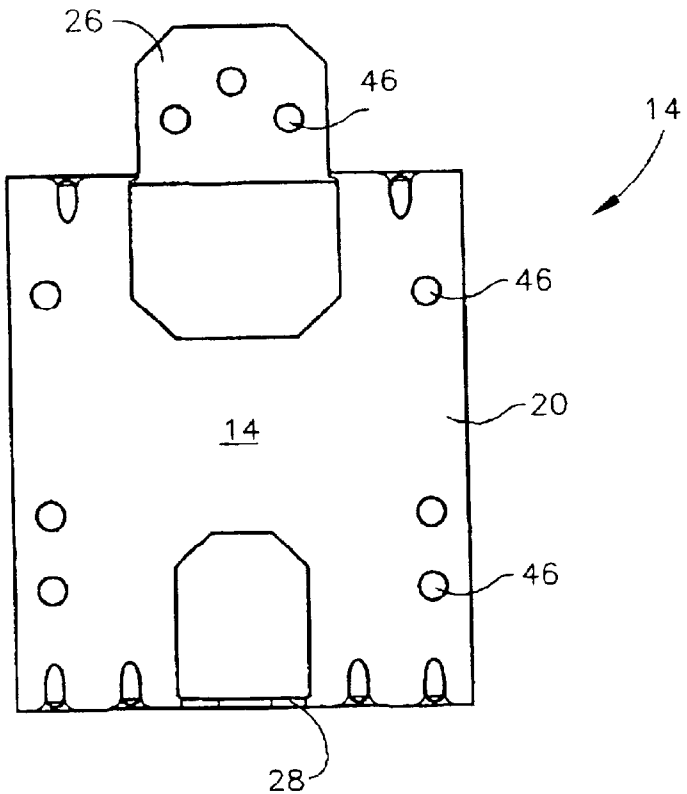
FIG. 4 is an end view of one of the end brackets of the hanger assembly of FIG. 1.

FIG. 4, an end view of one of the end bracket 14 as viewed from the left side of FIG. 1, depicts the vertical tab 26 and end flange 20 both of which include apertures 46 for receipt of fasteners (not shown) for later securing the hanger assembly between overhead joists. Apertures 46 are included in the horizontal tab 28 (not shown), vertical tab 26, and end flange 20 for the receipt of fasteners (not shown) during installation of the hanger assembly 10.

For the preferred embodiment of the hanger assembly 10, the length of the longitudinal member 12 is 21.5 inches and the end brackets 14 extend the overall length, with the end brackets 14 arranged orthogonal to the longitudinal member 12, of the hanger assembly 10 to 22.5 inches. The length of the longitudinal member 12 could be set longer than 21.5 inches, but typically the preferred length is sufficient to span most overhead joists, which typically are spaced at 24 inches or less center to center. The preferred width of the longitudinal member is 1.5 inches and the preferred height between the top 16 and bottom 18 is 3.5 inches.

Figure 6:
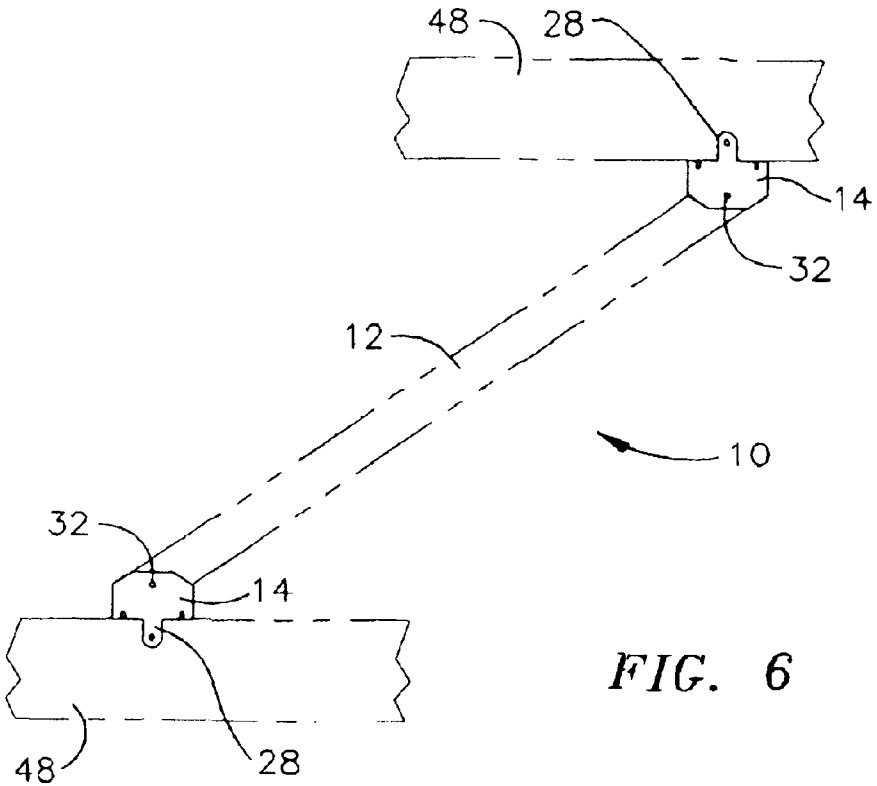
FIG. 6 is a bottom view showing the arrangement of the hanger assembly of FIG. 1 when used to span between joists spaced 18 inches apart.
Figure 5:
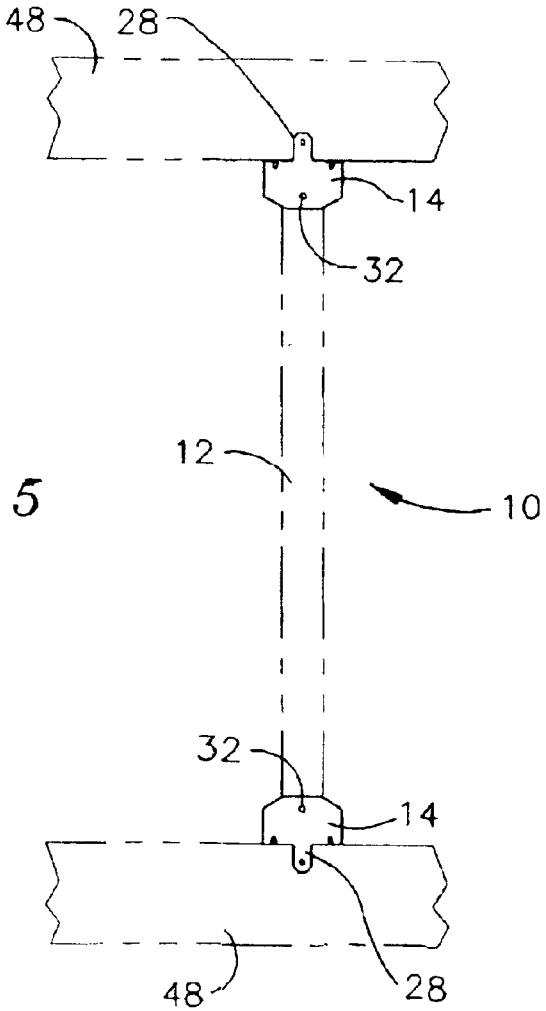
FIG. 5 is a bottom view showing the arrangement of the hanger assembly of FIG. 1 when used to span between joists spaced 24 inches apart.
Figure 8:
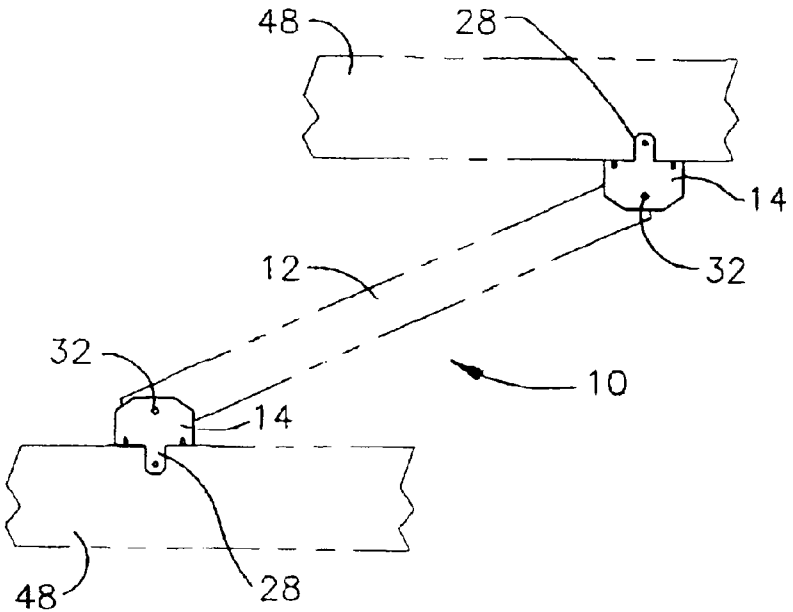
FIG. 8 is a bottom view showing the arrangement of the hanger assembly of FIG. 1 when used to span between joists spaced 12 inches apart.
Figure 7:
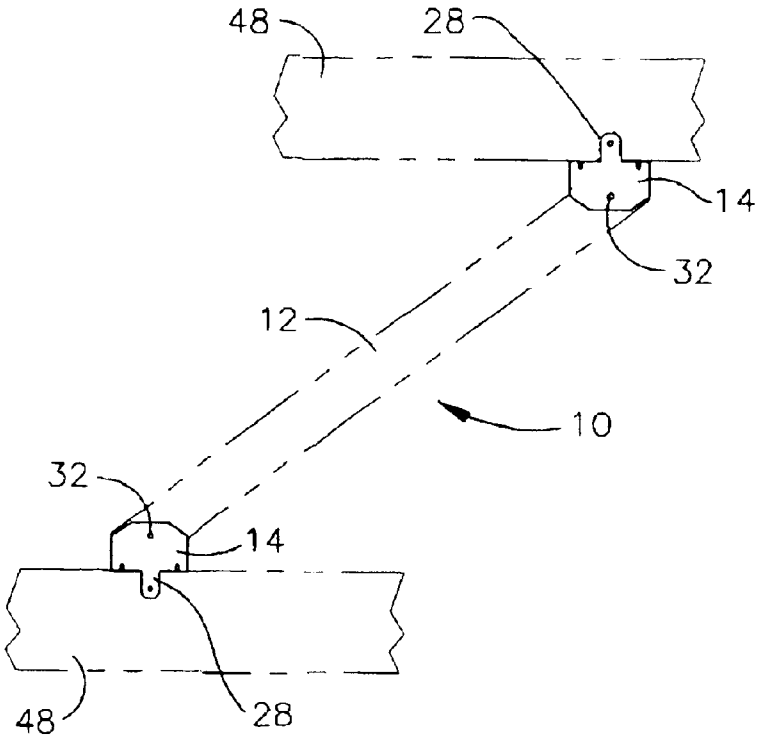
FIG. 7 is a bottom view showing the arrangement of the hanger assembly of FIG. 1 when used to span between joists spaced 16 inches apart.

FIGS. 5 through 8 are bottom views of the preferred embodiment of the hanger assembly 10, viewed from the perspective of looking upwards at the overhead joists, illustrating the arrangement of the preferred embodiment of the hanger assembly 10 when used to span between adjacent joists 48 spaced at various distances. For example, as shown in FIG. 5, when used to span between adjacent joists 48 spaced 24 inches apart center to center (c/c), the end brackets 14 are pivoted orthogonal to the longitudinal member 12 and the longitudinal member 12 therefore is orthogonal to the joists 48. Referring to FIG. 6 as a second example, with the adjacent joists 48 spaced at 18 inches c/c, the end brackets 14 are pivoted as shown to the longitudinal member 12 and the longitudinal member 12 therefore is at an angle of approximately 45° to the joists 48. As depicted in the third example of FIG. 7, with the adjacent joists 48 spaced at 16 inches c/c, the end brackets 14 are pivoted as shown to the longitudinal member 12 and the longitudinal member 12 therefore is at an angle of approximately 37° to the joists 48. For a final example, as depicted in FIG. 8, with the adjacent joists 48 spaced at 12 inches c/c, the end brackets 14 are angled as shown to the longitudinal member 12 and the longitudinal member 12 therefore is at an angle of approximately 25° to the joists 48. As suggested by the various examples depicted in FIGS. 5 through 8, the preferred embodiment of the hanger assembly 10 of the present invention can easily span a wide range of joist geometries including spans of 4.0 inches c/c to 24.0 inches c/c. Smaller or larger distances may be spanned by varying the length or width of the longitudinal member 12 from the dimensions selected for the preferred embodiment.

Figure 9:
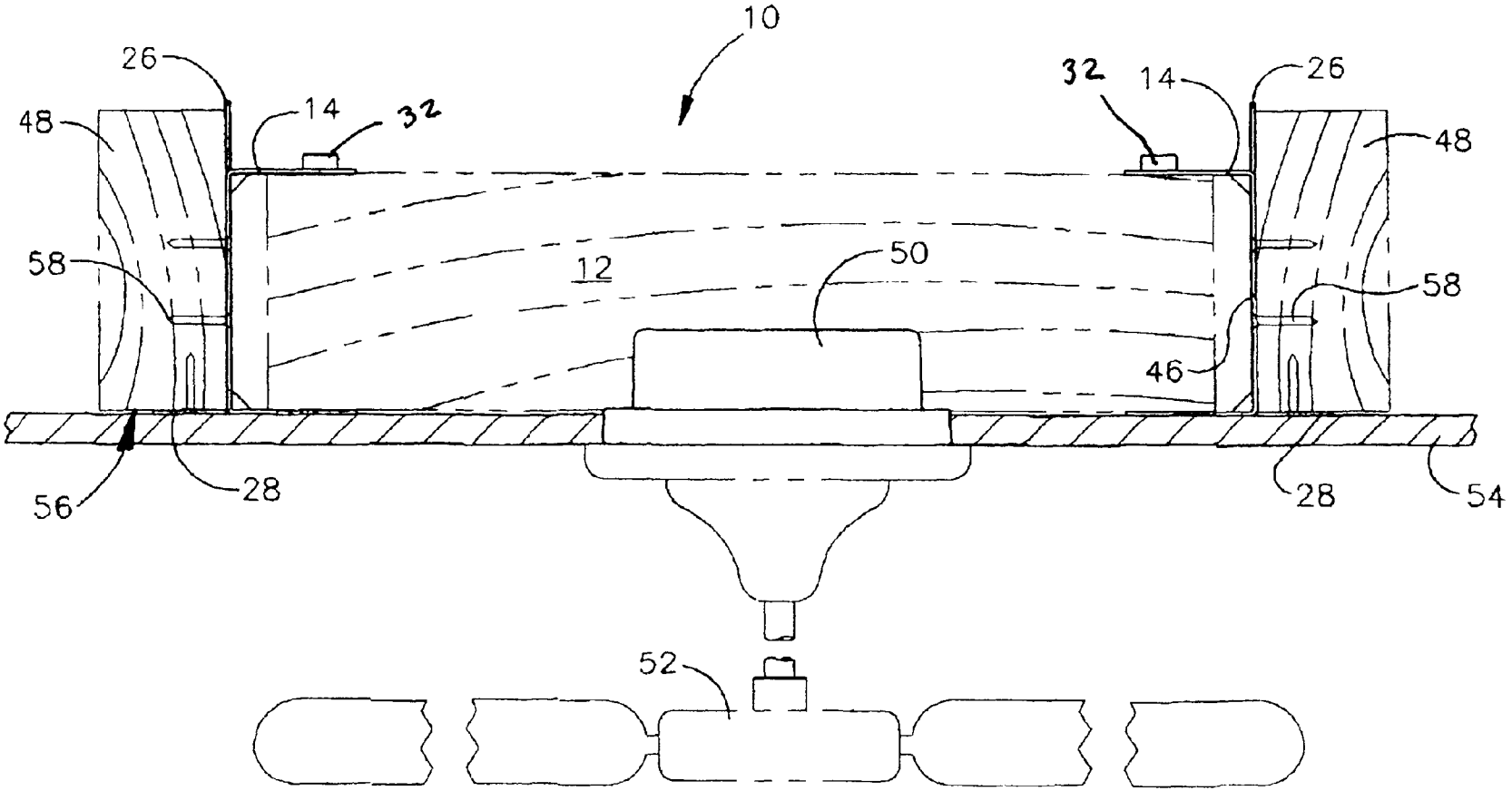
FIG. 9 is a side view depicting the hanger assembly of FIG. 1 installed between two joists and including an attached junction box and a ceiling fan.

Referring to FIG. 9, a side view is shown of the preferred embodiment of the hanger assembly 10 installed between two joists 48 with an attached junction box 50 and a ceiling fan 52 secured thereto. FIG. 9 includes a ceiling 54, typically consisting of dry wall, secured to the lower edge 56 of the joists 48. To install a light fixture (not shown) or a ceiling fan 52 between two existing overhead joists 48, a hanger assembly 10 is provided and the end brackets 14 are pivoted with respect to the longitudinal member 12 until the total length of the hanger assembly 10 spans the distance between the two joists 48. The hanger assembly 10 is then inserted between the two joists 48 such that, referring to FIG. 1, the joist-accepting seat 44 of each end bracket 14 is flush against its respective joist 48. Referring again to FIG. 9, fasteners 58 are then hammered or threaded through apertures 46 in the horizontal tab 28, vertical tab 26, or end flange 20 as appropriate to secure the hanger assembly 10 to the joists 48. When secured to the joists 48, the horizontal tab 28 is flush against the lower edge 56 of the joists 48 and therefore a ceiling 54, typically consisting of sheet rock, may be secured to the lower edge 56 of the adjacent joists 48 and other joists in the vicinity to cover the joists. Alternatively, the hanger assembly 10 may be used to suspend a heavy object from two adjacent rafters where the rafters in the room are visible. In this case, the hanger assembly 10 would be used to provide support between two adjacent rafters and no covering material such as sheet rock would be used.

After the hanger assembly 10 is secured to the joists 48 with fasteners 58, as shown in FIG. 9, an appropriate junction box 50 is secured to the hanger assembly 10 in the usual manner. The junction box 50 may be of a circular shape that is typically used with hanging light fixtures or ceiling fans or may be of the L-shaped type or of the type that contains a U-shaped channel in the top of the junction box to accommodate an overhead joist. The electrical wiring and the installation of the light fixture or ceiling fan 52 are then completed in the typical manner.

The preferred material of construction for the end bracket is 1/16" thick pre-galvanized steel, however, it should be understood that the end brackets may be provided in various gauges without departing from the scope of the invention. The material of construction of the end brackets can also consist of various other materials such as rigid plastic, aluminum, titanium, fiberglass, etc., without departing from the scope of the invention.

The longitudinal member is preferably constructed from a typical piece of 2"×4" wood such as that used for framing houses. It should be apparent that other materials, such as fiberglass, rigid plastic, steel, aluminum, or various other materials could also easily be used to construct the longitudinal member.

The preferred material for constructing a pivot pin is a ¼-20×4 long flathead screw and a mating lock nut. Other types, lengths, and diameters of cylindrical fasteners and locking means, or other means such as a cylindrical pin with a cotter key, may be used to connect the end brackets pivotably to the longitudinal member without departing from the scope of the invention.

Although the description above contains many specific descriptions, materials, and dimensions, these should not be construed as limiting the scope of the invention but as merely providing illustrations of some of the presently preferred embodiments of this invention.

Thus the scope of the invention should be determined by the appended claims and their legal equivalents, rather than by the examples given.

What is claimed is:

1. A hanger assembly for suspending a load from adjacent overhead joists, comprising:

a longitudinal member;

end brackets, one attached pivotably to each end of said member;

apertures in each of said end brackets for receipt of fasteners for securely anchoring each of said end brackets to two adjacent overhead joists; and said longitudinal member and said brackets do not extend substantially beyond a plane connecting the lower edges of said joists when secured thereto.

2. The hanger assembly of claim 1 wherein said end brackets are U-shaped with the middle of said U-shaped bracket forming a channel capable of accepting the ends of said longitudinal member.

3. The hanger assembly of claim 2 wherein said U-shaped brackets are attached pivotably to each end of said member by a pivot pin inserted through an aperture in each side portion of said U-shaped bracket and through an aperture in the end of said member, with said aperture in said side portion and said aperture in the end of said member in alignment with each other.

4. A method of providing a hanger assembly for suspending a load from adjacent overhead joists including:

providing a longitudinal member including two end brackets pivotably attached to said longitudinal member such that said end brackets allow said longitudinal member to pivot with respect to said end brackets and said brackets including apertures;

pivoting said end brackets horizontally with respect to said longitudinal member until the end brackets are parallel to each other and the longitudinal offset between them is equal to the distance between two adjacent joists they will be used in conjunction with;

inserting said longitudinal member and said pivotably attached end brackets into the space between said adjacent joists; and attaching said hanger assembly to said adjacent joists by driving fasteners through said apertures in said end brackets and into the joists such that said longitudinal member and said end brackets do not extend substantially beyond a plane connecting the lower edges of said joists when secured thereto.

* * * * *